US007027026B2

(12) United States Patent
Tsutsui

(10) Patent No.: US 7,027,026 B2
(45) Date of Patent: Apr. 11, 2006

(54) DISPLAY DEVICE

(75) Inventor: Yusuke Tsutsui, Hashima (JP)

(73) Assignee: Sanyo Electric Co., Ltd., Osaka (JP)

( * ) Notice: Subject to any disclaimer, the term of this patent is extended or adjusted under 35 U.S.C. 154(b) by 329 days.

(21) Appl. No.: 10/120,147

(22) Filed: Apr. 11, 2002

(65) Prior Publication Data

US 2002/0190969 A1 Dec. 19, 2002

(30) Foreign Application Priority Data

Apr. 11, 2001 (JP) ..... 2001-112725

(51) Int. Cl.
*G09G 3/36* (2006.01)

(52) U.S. Cl. ..... 345/98; 345/76

(58) Field of Classification Search ..... 345/205, 345/206, 87–104, 76–83; 315/169.3; G09G 3/30, G09G 3/32, 3/34, 3/36
See application file for complete search history.

(56) References Cited

U.S. PATENT DOCUMENTS 5,526,012 A * 6/1996 Shibahara ..... 345/92
5,712,652 A 1/1998 Sato et al.
5,790,090 A 8/1998 Libsch et al.
5,945,972 A 8/1999 Okumura et al.
5,952,991 A 9/1999 Akiyama
5,977,940 A 11/1999 Akiyama et al.
6,023,308 A 2/2000 Takemura
6,072,454 A 6/2000 Nakai et al.
6,642,916 B1 * 11/2003 Kodama et al. ..... 345/100
6,771,247 B1 * 8/2004 Sato et al. ..... 345/98

FOREIGN PATENT DOCUMENTS

| | | |
|---|---|---|
| EP | 0 797 182 | 9/1997 |
| EP | 1 020 840 | 7/2000 |
| JP | 58-23091 | 2/1983 |
| JP | 08-194205 | 7/1996 |
| JP | 09-236823 | 9/1997 |
| JP | 2001-242819 | 9/2001 |

* cited by examiner

*Primary Examiner*—Alexander Eisen
(74) *Attorney, Agent, or Firm*—Morrison & Foerster LLP

(57) ABSTRACT

A display device has a power line providing a retaining circuit with a power voltage, which is also used as a storage capacitance line connected to one of the electrodes of a storage capacitor. The storage capacitance line is disposed parallel to gate signal lines in a pixel element of the device. The power line of two inverter circuits, which form the retaining circuit, extends in the direction perpendicular to the storage capacitance line and is connected to the storage capacitance line. This configuration helps to reduce the overall size of the display device.

3 Claims, 6 Drawing Sheets

DISPLAY DEVICE

BACKGROUND OF THE INVENTION

1. Field of the Invention

This invention relates to a display device, specifically to a display device which is incorporated into a portable communication and computing device.

2. Description of the Related Art

There has been a great demand in the market for portable communication and computing devices such as a portable TV and a cellular phone. All these devices need a small, light-weight and low-power consumption display device, and efforts have been made accordingly.

FIG. 5 shows a circuit diagram corresponding to a single pixel element of a conventional liquid crystal display device. A gate signal line 51 and a drain signal line 61 are placed on an insulating substrate (not shown) perpendicular to each other. A thin-film transistor (TFT) 72 connected to two signal lines 51, 61, is formed near the intersection of the two signal lines 51, 61. A source 11*s* of the TFT 72 is connected to a display electrode 80 of a liquid crystal 21.

A storage capacitor element 85 holds the voltage of the display electrode 80 during one field period. One terminal 86 of the storage capacitor 85 is connected to the source 11*s* of the TFT 72 and the other terminal 87 is provided with a voltage common among all the pixel elements.

When a scanning signal is applied to the gate signal line 51, the TFT 72 turns to an on-state. Accordingly, an analog image signal from the drain signal line 61 is applied to the display electrode 80, and the storage capacitor 85 holds the voltage. The voltage of the image signal is applied to the liquid crystal 21 through the display electrode 80, and the liquid crystal 21 aligns in response to the applied voltage for providing a liquid crystal display image.

Therefore, this configuration is capable of showing both moving images and still images. There is a need for the display to show both a moving image and a still image within a single display. One such example is to show a still image of a battery within an area of a moving image of a cellular phone display to show the remaining amount of the battery power.

However, the configuration shown in FIG. 5 requires a continuous rewriting of each pixel element with the same image signal at each scanning in order to provide a still image. This is basically to show a still-like image in a moving image mode, and the scanning signal needs to activate the TFT 72 at each scanning.

Accordingly, it is necessary to operate a driver circuit which generates a driver signal for the scanning signals and the image signals, and an external LSI which generates various signals for controlling the timing of the driver circuit, resulting in a significant electric power consumption. This is a considerable drawback when such a configuration is used in a cellular phone device which has only a limited power source. That is, the time a user can use the telephone under one battery charge is considerably decreased.

Japanese Laid-Open Patent Publication No. Hei 8-194205 discloses another configuration for a display device suitable for portable applications. This display device has a static memory for each of the pixel elements, as shown in FIG. 6. A static memory, in which two inverters INV1 and INV2 are positively fed back to each other, holds the image signal. This results in reduced power consumption.

In this configuration, a switching element 24 controls the resistance between a reference line and a display electrode 80 in response to the divalent digital image signal held by the static memory in order to adjust the biasing of the liquid crystal 21. The common electrode, on the other hand, receives an AC signal Vcom. Ideally, this configuration does not need to refresh the memory when the image stays still for a period of time.

As described above, the conventional liquid crystal display device is suitable for displaying a full color moving picture in response to the analog image signal. On the other hand, the liquid crystal display device with a static memory for retaining the digital image signal is suitable for displaying a low-depth still picture with low power consumption.

However, two liquid crystal display devices described above have different sources for image signals. Thus, it is impossible to have both images within a single display device.

Therefore, this invention is directed to a display device, which can alternate between two kinds of display modes, an analog display mode and a digital display mode.

SUMMARY OF THE INVENTION

The invention provides a display device including a plurality of gate signal lines disposed in a first direction and a plurality of drain signal lines disposed in a second direction different from the first direction. A plurality of pixel elements are disposed in a matrix configuration and are selected by a scanning signal fed from one of the gate signal lines and provided with an image signal fed from one of the drain signal lines. A plurality of display electrodes are disposed in the corresponding pixel elements. The device has a first display circuit, which is disposed for a corresponding pixel element, has a storage capacitance element for retaining the image signal inputted from one of the drain signal lines and supplies the image signal to the display electrode. The first display circuit conforms to an analog display mode. The device also has a second display circuit, which is disposed for the pixel element of the first display circuit, has a retaining circuit for retaining the image signal and supplies a voltage corresponding to the signal retained in the retaining circuit to the pixel element. The second display circuit conforms to a digital display mode. A circuit selection circuit is provided for selecting the first display circuit or the second display circuit in response to a circuit selection signal. The device has a high voltage line of a power line for supplying a power voltage to the retaining circuit. This high voltage line is also used as a storage capacitance line connected to one of electrodes of the storage capacitance element.

In this device configuration, a low voltage line, instead of the high power line, of a power line for supplying a power voltage to the retaining circuit may be also used as a storage capacitance line connected to one of electrodes of the storage capacitance element.

The invention also provides a display device including a plurality of gate signal lines disposed in a first direction for receiving a scanning signal and a plurality of drain signal lines disposed in a second direction different from the first direction. A plurality of pixel element selection transistors are disposed in the corresponding pixel elements for selecting pixel elements in response to the scanning signal fed from one the gate signal lines. A retaining circuit is disposed for a corresponding pixel element for holding an image signal inputted from one of the drain signal lines. The device also has a low voltage line of a power line for supplying an earth voltage to the retaining circuit. The low voltage line is connected to a gate signal line corresponding to a line scanning line prior to a line scanning of the retaining circuit in an image scanning sequence.

The configurations described above help to reduce the overall size of the display device.

DETAILED DESCRIPTION OF THE INVENTION

This invention is directed to a display device, which can alternate between two kinds of display modes, an analog display mode and a digital display mode, as described in commonly owned copending U.S. patent application Ser. No. 09/953,233, entitled "DISPLAY DEVICE AND ITS CONTROL METHOD." The disclosure of U.S. patent application Ser. No. 09/953,233 is in its entirety incorporated herein by reference.

Figure 7:
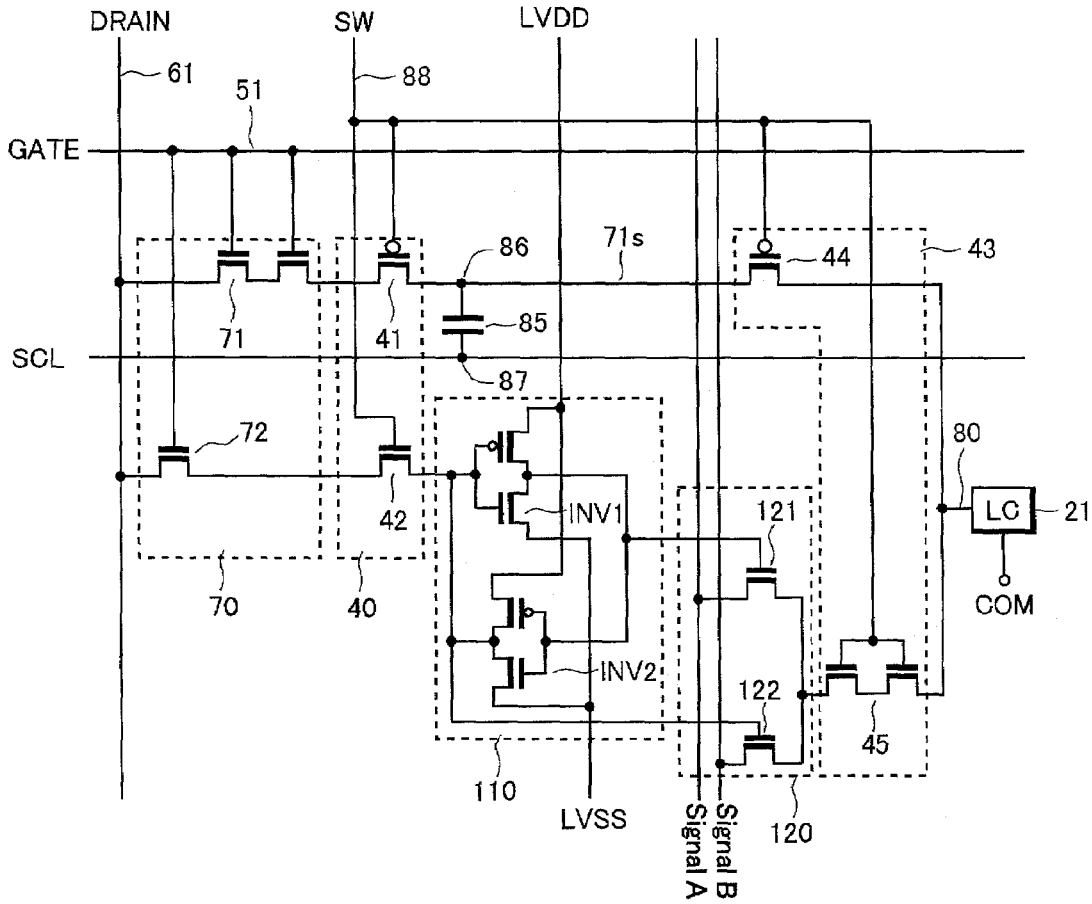
FIG. 7 is a circuit diagram of a display device which forms a basis of this invention.

FIG. 7 shows a circuit diagram, which forms a basis of embodiments of this invention.

On an insulating substrate (not shown in the figure), a circuit selection circuit 40, comprising a P channel TFT 41 and an N channel TFT 42, is formed near the crossing of a gate signal line 51 and a drain signal line 61. Both drains of the TFTs 41, 42 are connected to the drain signal line 61, and both gates are connected to a circuit selection signal line 88. The TFTs 41, 42 complementarily turn on according to a selection signal fed from the circuit selection signal line 88. Also, a pair of circuit selection circuits 40, 43 are provided.

A pixel element selection circuit 70 comprising an N channel TFT 71 and an N channel TFT 72 is formed adjacent to the circuit selection circuit 40. The TFTs 71, 72 turn on according to the scanning signal fed from the gate signal line 51.

In the pixel element, a storage capacitance element 85 for holding an analog image signal for one field period is also formed. One electrode 86 of the storage capacitance element 85 is connected to the source 71*s* of the TFT 71. The other electrode 87 is connected to the storage capacitance line SCL commonly used among the entire pixel elements and receives a predetermined bias voltage.

Between the storage capacitance element 85 and a liquid crystal 21, a P channel TFT 44 of the circuit selection circuit 43 is formed, turning on and off, synchronizing with the TFT 41 of the circuit selection circuit 40. Between the pixel element selection TFT 72 and the display electrode 80 of the liquid crystal 21, a retaining circuit 110 and a signal selection circuit 120 are formed.

The retaining circuit 110 comprises first and second inverter circuits, INV1, INV2, which are positively fed back to each other. Under the digital display mode, when the voltage at the circuit selection signal line 88 becomes "H", and when the scanning signal of the gate signal line 51 also becomes "H", the image signal inputted from the drain signal line 61 is written into the retaining circuit 110.

The signal selection circuit 120 selects the signal according to the digital image signal retained in the retaining circuit 110, and includes two N channel TFTs 121, 122. Since the complimentary output signal is applied to the gates of the TFTs 121, 122 from the retaining circuit 110, the TFTs 121, 122 complementarily turn on and off. When TFT 122 turns on, the signal A (black signal) is selected, and when the TFT 121 turns on, the signal B (white signal) is selected. Then the selected signal is supplied to the display electrode 80, which applies the voltage to the liquid crystal 21, through the TFT 45 of the circuit selection circuit 43.

Therefore, in the above configuration, switching between the conventional analog display mode and the digital display mode (low power consumption, for still image display) is possible. However, since the wiring for the power line LVDD supplying the power voltage and the earth line LVSS for providing the earth voltage (or reference voltage) to the retaining circuit 110 is required in the above configuration, reducing the size of the pixel element circuit is difficult.

Figure 1:
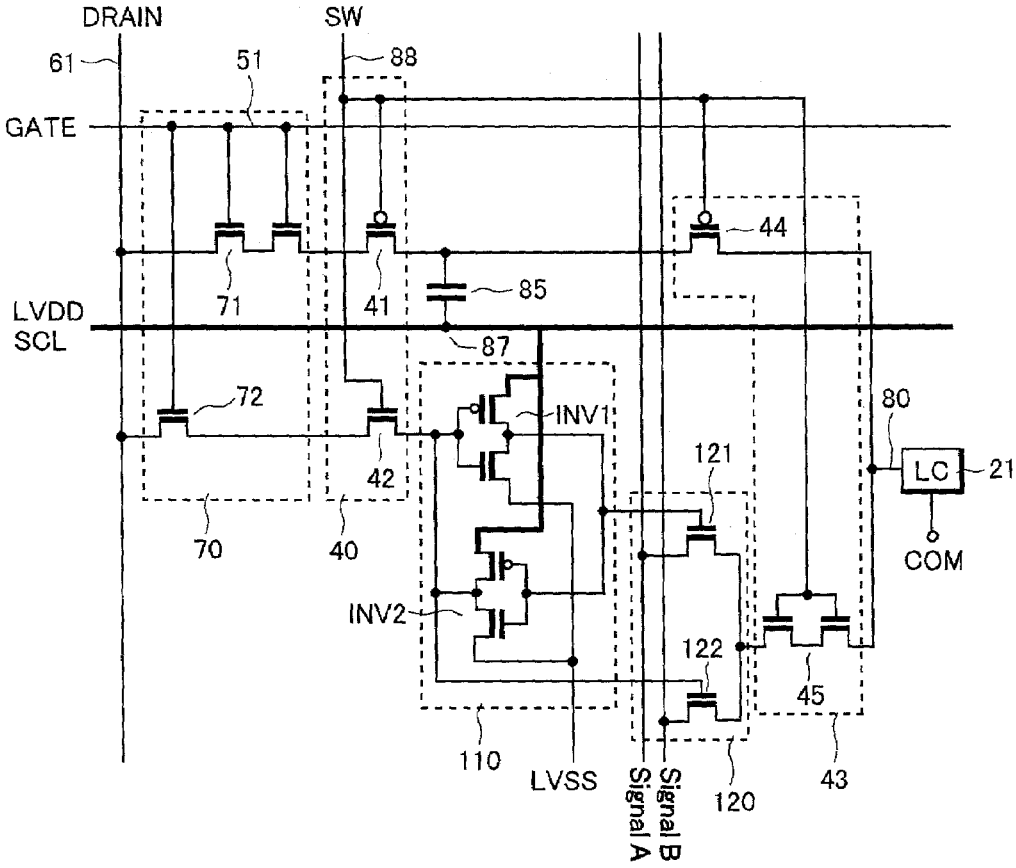
FIG. 1 is a circuit diagram of a liquid crystal display device of a first embodiment of this invention.

FIG. 1 shows a circuit diagram of a display device of a first embodiment of this invention. In FIG. 1, for the sake of simplicity, only one pixel element is shown. However, in the display device, a plurality of pixel elements with the same configuration are disposed in the matrix configuration. Portions of FIG. 1 are the same as the corresponding portions of FIG. 7 and the same reference numerals are used for those portions. Accordingly, descriptions of the same portions will be omitted.

As shown in FIG. 1, in response to the selection signal SW fed from the circuit selection signal line 88, the switching between the circuit selection circuits 40, 43 takes place, selecting a first display circuit (for analog display) with a storage capacitance element 85 or a second display circuit (for digital display) with a retaining circuit 110 and a signal selection circuit 120.

In this embodiment, the wiring area is reduced by using one wiring line both as a power line LVDD for providing the retaining circuit 110 with a power voltage and as a storage capacitance line SCL connected to one of the electrodes of the storage capacitance element 85. The storage capacitance line SCL is disposed in the pixel element parallel to the gate signal line 51. The power line of the inverter circuits INV1, INV2, which form the retaining circuit 110, extends in the direction perpendicular to the storage capacitance line SCL and is connected to the storage capacitance line SCL. The level of the storage capacitance line SCL is fixed at the power voltage (for example, 5V).

Figure 2:
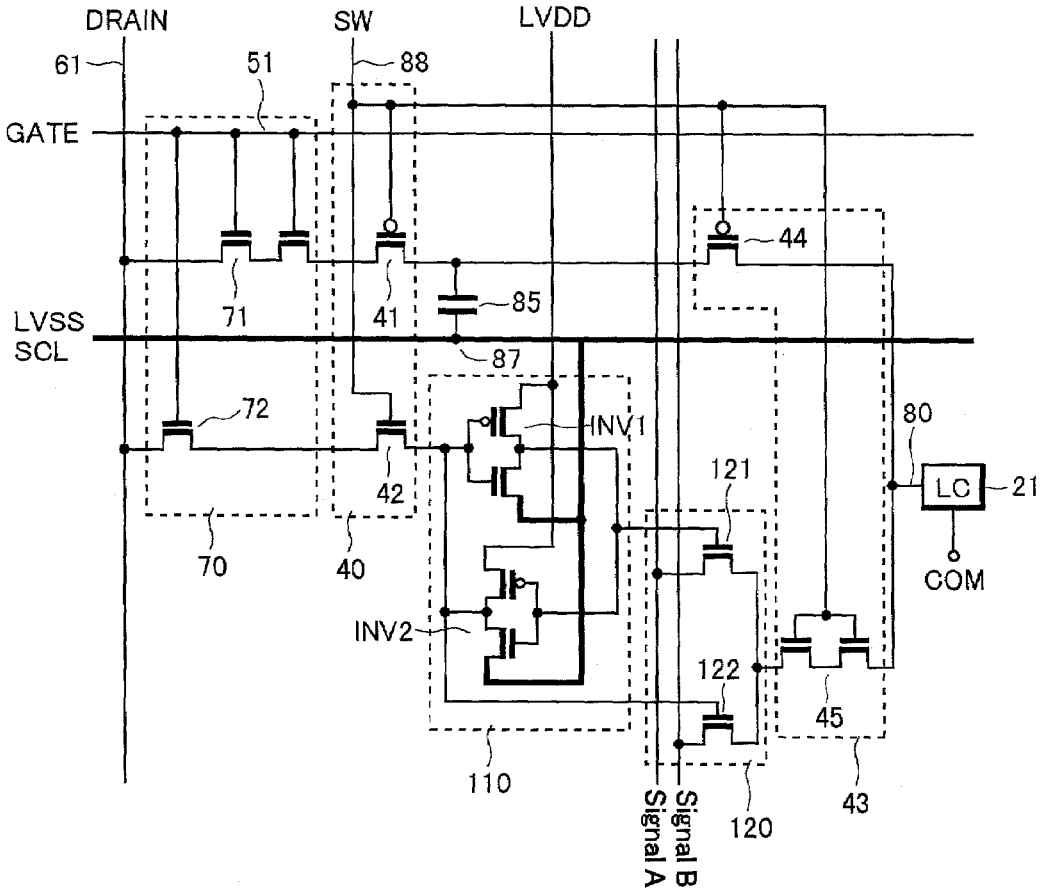
FIG. 2 is a circuit diagram of a liquid crystal display device of a second embodiment of this invention.

FIG. 2 shows the circuit diagram of a second embodiment of the display device of this invention. In FIG. 2, for the sake of simplicity, only one pixel element is shown. However, in the display device, a plurality of pixel elements with the same configuration are disposed in the matrix configuration. Portions of FIG. 2 are the same as the corresponding portions of FIG. 7 and the same reference numerals are used for those portions. Accordingly, descriptions of the same portions will be omitted.

As shown in FIG. 2, in response to the selection signal SW fed from the circuit selection signal line 88, switching between the circuit selection circuits 40, 43 takes place, selecting the first display circuit (for analog display mode) with the storage capacitance element 85 or the second display circuit (for digital display mode) with the retaining circuit 110 and the signal selection circuit 120. This is the same as in the first embodiment.

In this embodiment, the wiring area is reduced by using one wiring line as a power line LVSS for providing the retaining circuit 110 with an earth voltage and as a storage capacitance line SCL connected to one of the electrodes of the storage capacitance element 85. The storage capacitance line SCL is disposed in the pixel element parallel to the gate signal line 51. The earth line of the inverter circuits INV1, INV2, which form the retaining circuit 110, extends in the direction perpendicular to the storage capacitance line SCL and is connected to the storage capacitance line SCL. The level of the storage capacitance line SCL is fixed at the earth voltage (for example, 0V).

However, the level of the earth line LVSS is not necessarily limited to 0V, as long as the voltage of the wiring is lower than the power line LVDD.

Figure 3:
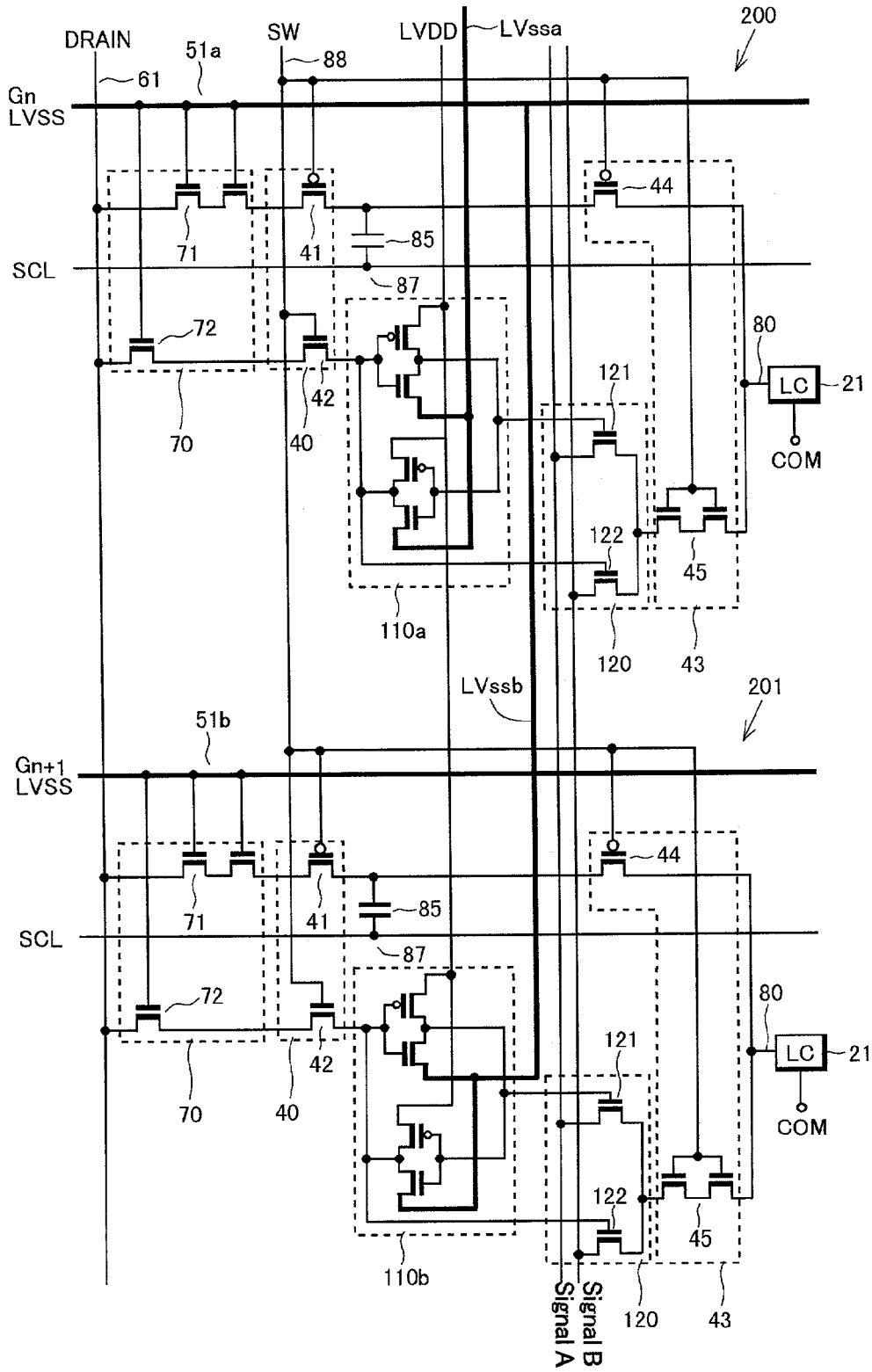
FIG. 3 is a circuit diagram of a liquid crystal display device of a third embodiment of this invention.

FIG. 3 shows the circuit diagram of the third embodiment of the display device of this invention. In FIG. 3, for the sake of simplicity, only two pixel elements 200, 201, adjacent to each other, are shown. However, in the display device, a plurality of pixel elements with the same configuration are disposed in the matrix configuration. Portions of FIG. 3 are the same as the corresponding portions of FIG. 7 and the same reference numerals are used for those portions. Accordingly, descriptions of the same portions will be omitted.

In response to the selection signal SW fed from the circuit selection signal line 88, the switching between the circuit selection circuits 40, 43 takes place, in each of the pixel elements 200, 201, selecting the first display circuit (for analog display mode) with the storage capacitance element 85 or the second display circuit (for digital display mode) with the retaining circuit 110 and the signal selection circuit 120.

In this embodiment, the earth line LVSSb for providing the earth voltage with the inverter circuits INV1, INV2 of the retaining circuit 110*b* in the pixel element 201 is connected to the gate signal line 51*a*, which is one row prior to the gate signal line 51*b* corresponding to the retaining circuit 110*b*. Likewise, the earth line LVSSa for providing the earth voltage with the inverter circuits INV1, INV2 of the retaining circuit 110*a* in the pixel element 200 is connected to the gate signal line (not shown in the figure), which is one row prior to the gate signal line 51*a* corresponding to the retaining circuit 110*a*.

Figure 4:
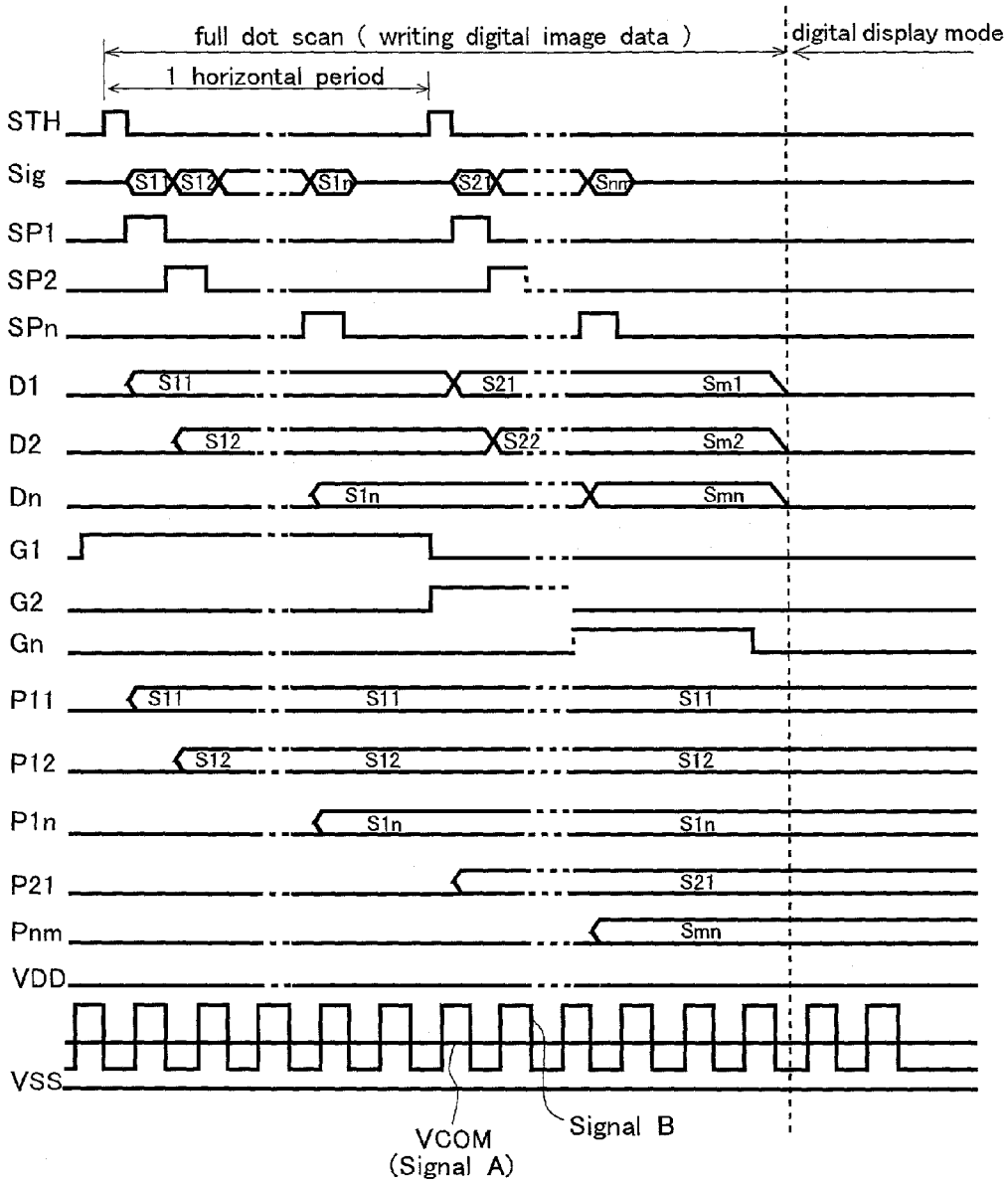
FIG. 4 is a timing chart of the liquid crystal display devices of the first, second and third embodiments.
Figure 5:
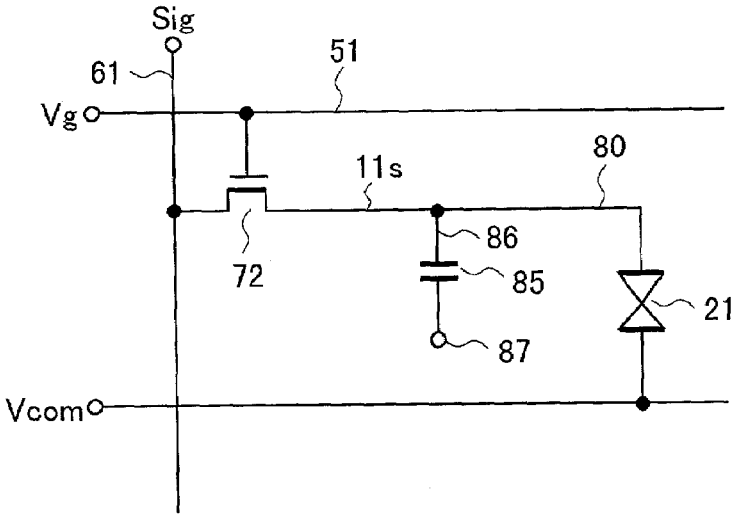
Fig.5 PRIOR ART
FIG. 5 is a circuit diagram of a conventional liquid crystal display device.
Figure 6:
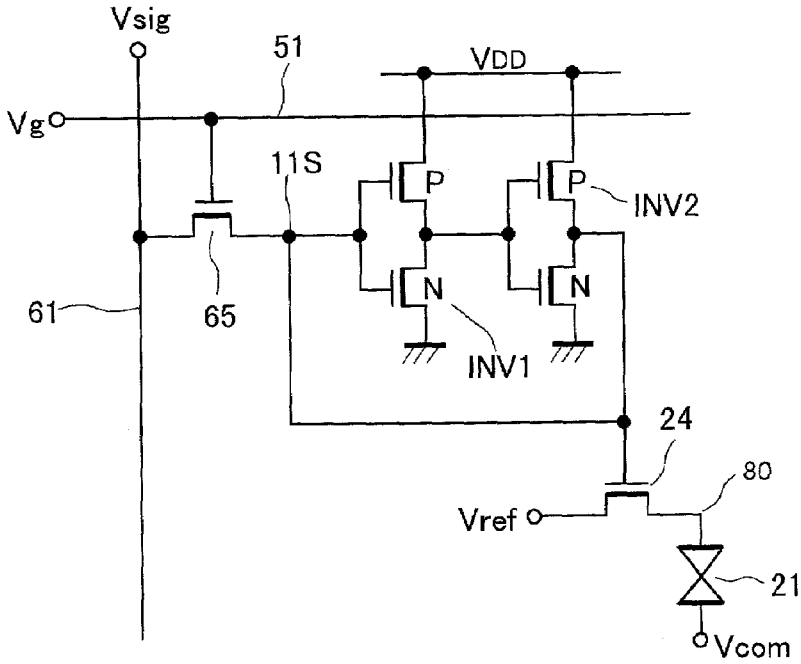
Fig.6 PRIOR ART
FIG. 6 is a circuit diagram of another conventional liquid crystal display device.

Next, the driving method of the display device of the third embodiment will be explained hereinafter in reference to FIGS. 3 and 4. FIG. 4 shows a timing chart of when the digital display mode is selected. The same driving method applies to the first and second embodiments.

(1) Analog Display Mode.

When the circuit selection signal line 88 is set to "L," the TFTs 41, 44 of the circuit selection circuits 40, 43 turn on. The sampling transistor SP (not shown) turns on in response to the sampling signal, in accordance with a horizontal start signal STH, so that the analog image signal is supplied to the drain signal line 61. Also, the scanning signal is supplied to the gate signal line 51 in accordance with the vertical start signal STV.

When the TFT 72 turns on in response to the scanning signal, the analog image signal is applied to the display electrode 80 through the drain signal line 61 and retained in the storage capacitance element 85. The liquid crystal 21 aligns itself in accordance with the image signal voltage applied to the liquid crystal 21 fed from the display electrode 80, resulting in a liquid crystal display. The analog display mode is suitable for showing a full color moving picture.

(2) Digital Display Mode

When the voltage of the circuit selection signal line 88 turns to "H", the TFTs 41, 44 of the circuit selection circuits 40, 43 turn off, and the TFTs 42, 45 turn on, making the retaining circuit 110 operable.

The LSI (not shown) for driver scanning on the external circuit board sends the start signals STV, STH to the gate driver and the drain driver, respectively. In response to the start signals, the sampling signals are sequentially generated. In response to each of the sampling signals, the respective sampling transistors SP1, SP2, - - - SPn connected to each of the drain signal lines 61 sequentially turn on, sampling the digital image signal and sending it to each of the drain signal lines 61.

The operation of the first row of the matrix, or the operation of the gate signal line 51, which receives the scanning signal G1, will be described below. First, the scanning signal G1 turns on each TFT of the pixel elements, P11, P12, - - - P1n (not shown) connected to the gate signal line 51, for one horizontal field period.

In the pixel element P11 located at the upper left corner of the matrix, the sampling signal SP1 takes in the digital image signal S11 (drain signal D1) and feeds it to the drain signal line 61. The scanning signal G1 becomes "H", turning the TFT 72 on and the digital image signal S11 is written into the retaining circuit 110.

In the pixel element P12 located at the first row and the second column of the matrix, the sampling signal SP2 takes in the digital image signal S12 (drain signal D2) and feeds it to the drain signal line 61. The rest of the operation is the same as described above.

The signal retained by the retaining circuit 110 is then fed to the signal selection circuit 120, and is used by the signal selection circuit 120 to select either signal A or signal B. The selected signal is then applied to the liquid crystal 21 through the display electrode 80. Thus, upon a completion of a scanning from the first gate signal line 51 on the top row of the matrix to the last gate signal line 51 on the bottom row of the matrix, the writing of a full display frame scan (one field scan) is completed.

When the scanning signal Gn+1(H) is applied to the gate signal line 51*b* connected to the pixel element selection TFT 72 of the pixel element 201 in FIG. 3, the digital image signal inputted to the drain signal line 61 is written into the retaining circuit 110*b*.

In the meantime, the level of the gate signal line 51*a* connected to the pixel element selection TFT 72 of the pixel element 200, which is adjacent to and prior to the pixel element 201, is at "L" (the earth voltage). Therefore, the inverter circuits INV1, INV2 of the retaining circuit 110*b* are provided with the earth voltage, leading to the correct operation of the retaining circuit 110*b*.

In this embodiment, the earth line LVSS, which supplies the earth voltage to the retaining circuit 110*b*, is connected to the gate signal line 51*a*, which is one row prior to the gate signal line 51*b* corresponding to the retaining circuit 110*b*. However, it is obvious that the same operation effect can be obtained when the earth line LVSS is connected to the gate signal line (not shown) two or more rows ahead.

Then, a display image in accordance with the data held in the retaining circuit 110 (digital display mode) appears. When the retaining circuit 110 receives the power voltage for its operation and when the common electrode receives the common electrode voltage VCOM (signal A), the liquid crystal display panel 100 is in the normally-white (NW) mode. In this mode, the same voltage as the common electrode 32 (VCOM) is applied to the signal A and the display voltage for the black display is applied to the signal B. In this way, the data for one still picture is retained and displayed.

When the retaining circuit 110 receives the digital image signal of "H" through the drain signal line 61, the first TFT 121 of the signal selection circuit 120 receives an "L" signal and, accordingly, turns off, and the second TFT 122 receives an "H" signal and turns on. In this case, the signal B is selected and the liquid crystal 21 receives the signal B having a phase opposite to the signal A applied to the common electrode 32, resulting in the rearrangement of the liquid crystal 21. Since the display panel is in an NW mode, a black image results.

When the retaining circuit 110 receives the digital image signal of "L" through the drain signal line 61, the first TFT 121 of the signal selection circuit 120 receives an "H" signal and, accordingly, turns on, and the second TFT 122 receives an "L" signal and turns off. In this case, the signal A is selected and the liquid crystal 21 receives the signal A, which is the same as the signal A applied to the common electrode 32. As a result, there is no change in the arrangement of the liquid crystal 21 and the display element stays white.

In this manner, the signals corresponding to one field are written in the retaining circuit 110, and a still image is displayed according to the signals retained in the retaining circuit 110. In this case, the drive of the driver circuits and the external LSI 91 for driver scanning is halted, resulting in a significant reduction of power consumption.

In the first, second, and third embodiments of this invention, the retaining circuit 110 is configured so that it only receives a one-bit digital image signal. However, this invention is not limited to this configuration. This invention is also applicable to the retaining circuit with a multiple-bit configuration, which can take and retain a plurality of digital image signals because the reduction of the wiring area leads to the size reduction of the pixel element circuit. Therefore, this invention leads to the fine and multi-gray scale display.

According to the display device of this invention, which is capable of switching between the analog display mode and the digital display mode, first, the power line that provides the retaining circuit with the power voltage for retaining the digital image signal is also used as the storage capacitance line. Therefore, the wiring area can be reduced, leading to a size reduction of the pixel element as well as the multi-gray scale display with the multiple-bit retaining circuit.

Second, the earth line providing the retaining circuit with the earth voltage is also used as the storage capacitance line connected to one of the electrodes of the storage capacitance element. Therefore, the wiring area can also be reduced, leading to the size reduction of the pixel element as well as the multi gray scale display with the multiple-bit retaining circuit.

Third, the earth line, which supplies the earth voltage to the retaining circuit, is connected to the gate signal line one row, or more, prior to the gate signal line corresponding to the retaining circuit in terms of the order of the scanning signal applied. Therefore, a line exclusively used as the earth line, which is required in the prior art, can be omitted. Thus, the wiring area can also be reduced, leading to a size reduction of the pixel element as well as the multi-gray scale display with the multiple-bit retaining circuit.

The above is a detailed description of the particular embodiments of the invention which are not intended to limit the invention to the embodiments described. It is recognized that modifications within the scope of the invention will occur to a person skilled in the art. Such modifications and equivalents of the invention are intended for inclusion within the scope of this invention.

What is claimed is:

1. A display device comprising:

a plurality of gate signal lines disposed in a first direction for receiving a scanning signal;

a plurality of drain signal lines disposed in a second direction different from the first direction;

a plurality of pixel elements disposed in a matrix configuration;

a plurality of pixel element selection transistors disposed in corresponding pixel elements for selecting the pixel elements in response to the scanning signal fed from one of the gate signal lines;

a retaining circuit disposed for a corresponding pixel element for holding an image signal inputted from one of the drain signal lines; and a power line for supplying a voltage to the retaining circuit, wherein a gate signal line connected to the pixel element selection transistors aligned in a row of the matrix branches out to contact the power line supplying the voltage to the retaining circuit located in another row of the matrix, and the retaining circuit comprises two inverter circuits positively feeding back to each other and the power line is connected to the two inverter circuits.

2. The display device of claim 1, wherein said row of the matrix is immediately next to said another row of the matrix.

3. The display device of claim 1, wherein said row of the matrix is prior to said another row of the matrix in a scanning sequence of the display device.

* * * * *